US009693130B1

(12) United States Patent
Desoto

(10) Patent No.: US 9,693,130 B1
(45) Date of Patent: Jun. 27, 2017

(54) MULTI-FUNCTIONAL EARPHONE DEVICE

(71) Applicant: Maryann Desoto, Mountain House, CA (US)

(72) Inventor: Maryann Desoto, Mountain House, CA (US)

( * ) Notice: Subject to any disclaimer, the term of this patent is extended or adjusted under 35 U.S.C. 154(b) by 0 days.

(21) Appl. No.: 15/000,295

(22) Filed: Jan. 19, 2016

(51) Int. Cl.
*H04R 25/00* (2006.01)
*H04R 1/10* (2006.01)
*H04R 1/02* (2006.01)

(52) U.S. Cl.
CPC ..... *H04R 1/1041* (2013.01); *H04R 1/02* (2013.01); *H04R 1/1025* (2013.01); *H04R 1/1033* (2013.01); *H04R 2420/09* (2013.01); *H04R 2430/01* (2013.01)

(58) Field of Classification Search
CPC . H04R 1/1041; H04R 1/1033; H04R 2420/09
USPC ..... 381/384, 370–374
See application file for complete search history.

(56) References Cited

U.S. PATENT DOCUMENTS 7,070,425 B2 * 7/2006 Regen ..... H01R 13/4532 439/131
8,811,646 B1 * 8/2014 Romeo ..... H04R 1/1033 381/370
2001/0035242 A1 * 11/2001 Hughs ..... H04B 1/3888 150/154
2013/0238829 A1 * 9/2013 Laycock ..... H04R 1/1033 710/303
2014/0345514 A1 * 11/2014 Pinder ..... G10K 5/00 116/137 R

* cited by examiner

*Primary Examiner* — Sunita Joshi
(74) *Attorney, Agent, or Firm* — Kyle A. Fletcher, Esq.

(57) ABSTRACT

The multifunctional earphone device is a multifunctional device adapted for use with personal data devices. Specifically, the multifunctional earphone device is a housing that contains a pair of earphones, a control system to remotely control the personal data device, and a power distribution system designed to charge personal data devices. The multifunctional earphone device comprises a housing, a plurality of earphones, a volume control, an audio source control, a charger, a USB cable, a first retractable spool, and a second retractable spool.

8 Claims, 6 Drawing Sheets

MULTI-FUNCTIONAL EARPHONE DEVICE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of acoustic transducers and the distribution of electric power, more specifically, a multifunctional accessory configured for use with personal data devices.

SUMMARY OF INVENTION

The multifunctional earphone device is a multifunctional device adapted for use with personal data devices. Specifically, the multifunctional earphone device is a housing that contains a plurality of earphones, a control system to remotely control the personal data device, and a power distribution system designed to charge personal data devices.

These together with additional objects, features and advantages of the multifunctional earphone device will be readily apparent to those of ordinary skill in the art upon reading the following detailed description of the presently preferred, but nonetheless illustrative, embodiments when taken in conjunction with the accompanying drawings.

In this respect, before explaining the current embodiments of the multifunctional earphone device in detail, it is to be understood that the multifunctional earphone device is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the multifunctional earphone device.

It is therefore important that the claims be regarded as including such equivalent construction insofar as they do not depart from the spirit and scope of the multifunctional earphone device. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
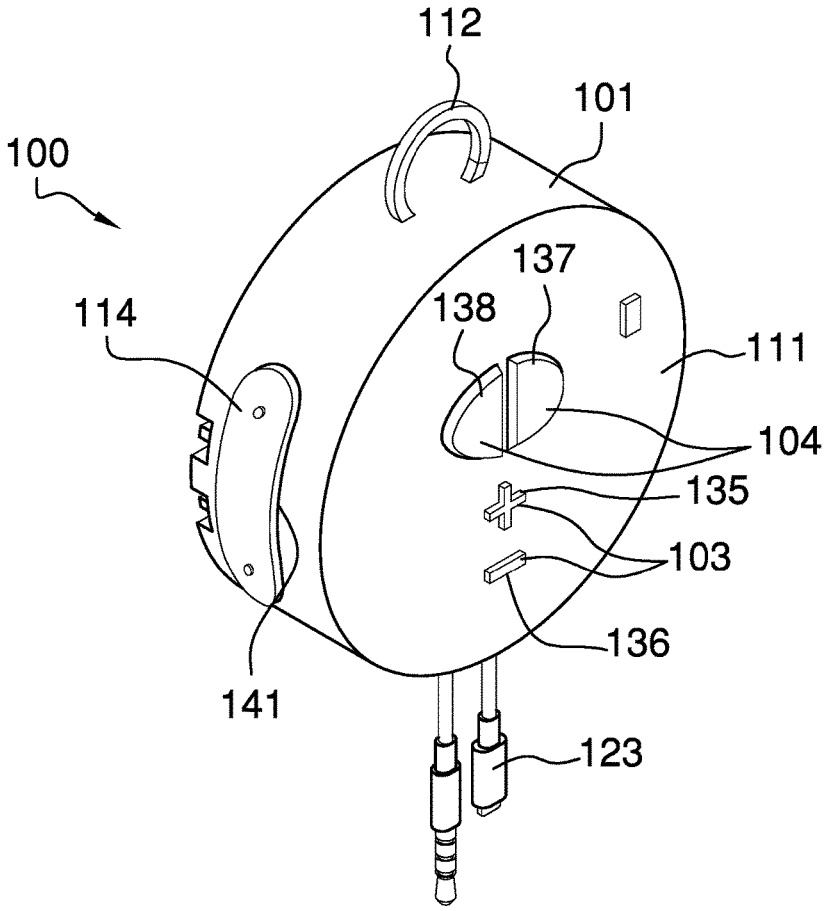
FIG. 1 is a perspective view of an embodiment of the disclosure.
Figure 2:
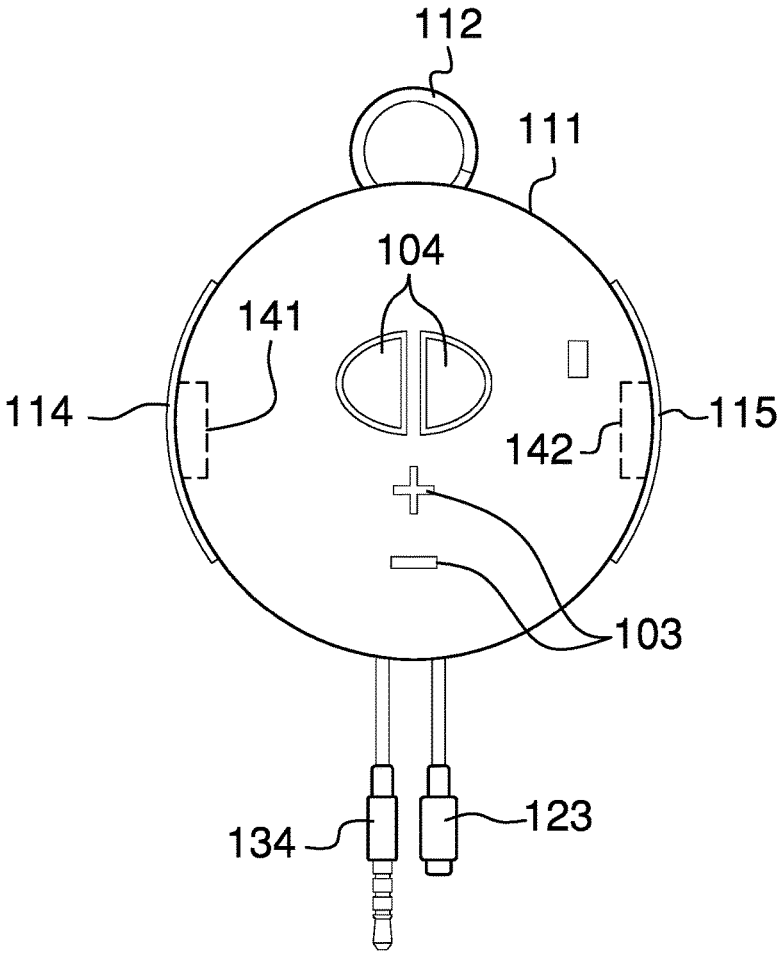
FIG. 2 is a front view of an embodiment of the disclosure.
Figure 3:
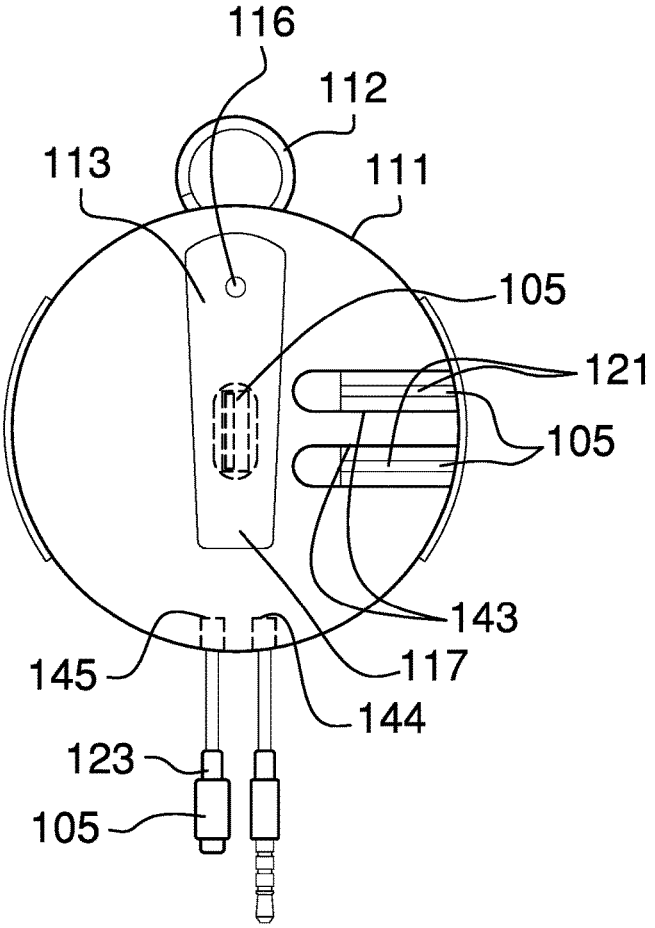
FIG. 3 is a rear view of an embodiment of the disclosure.
Figure 4:
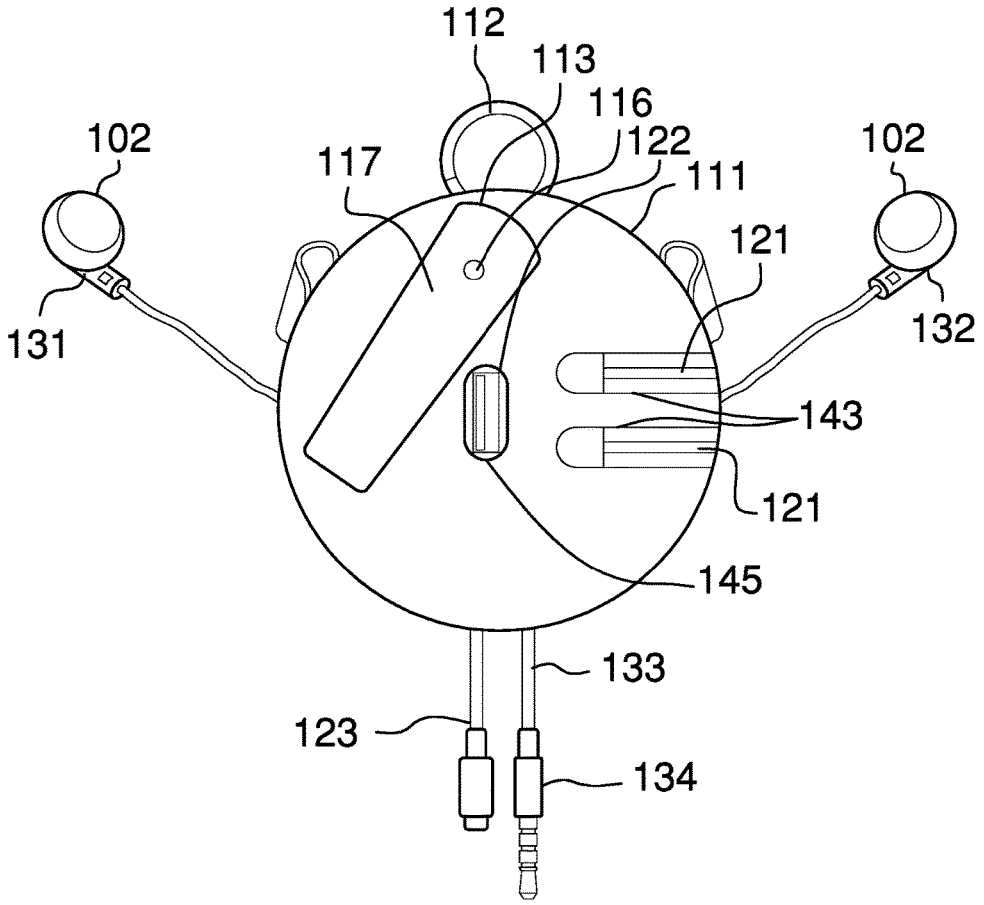
FIG. 4 is an exploded view of an embodiment of the disclosure.
Figure 5:
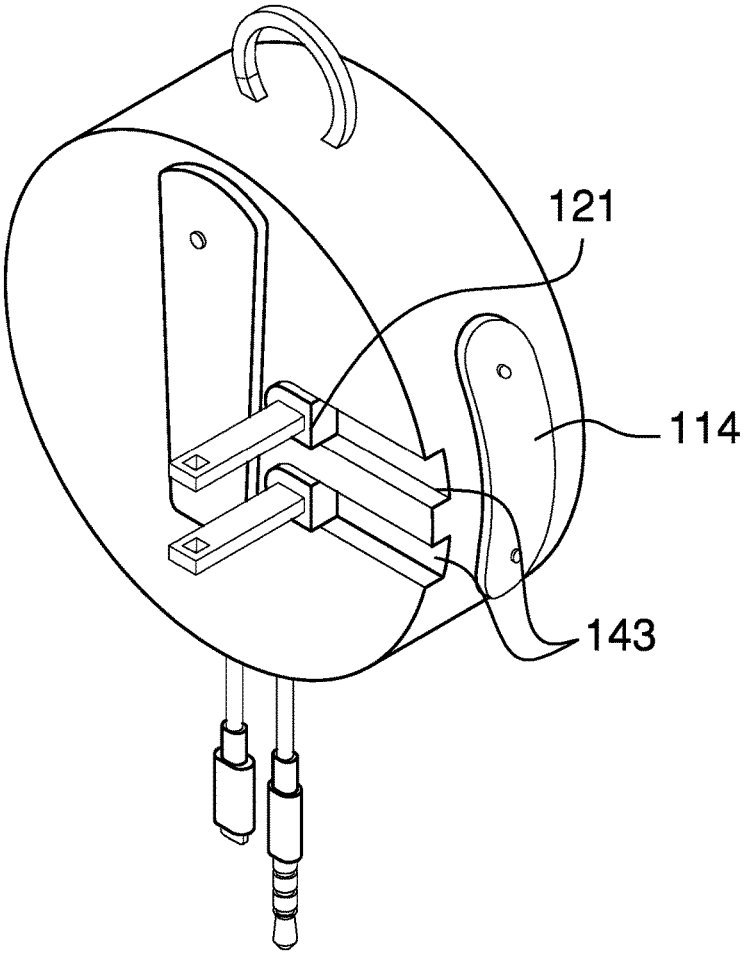
FIG. 5 is a rear perspective view of an embodiment of the disclosure.
Figure 6:
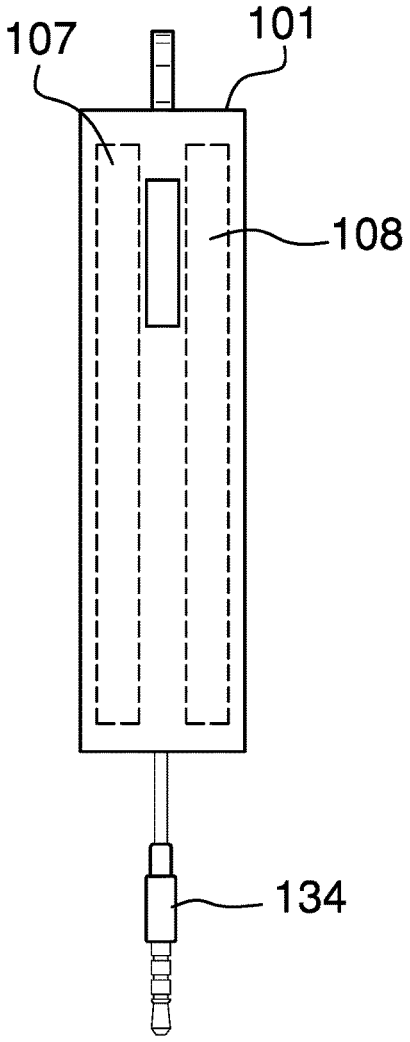
FIG. 6 is a side view of an embodiment of the disclosure.

Detailed reference will now be made to a first potential embodiment of the disclosure, which is illustrated in FIGS. 1 through 6.

The multifunctional earphone device 100 (hereinafter invention) comprises a housing 101, a plurality of earphones 102, a volume control 103, an audio source control 104, a charger 105, a USB cable plug 123, a first retractable spool 107, and a second retractable spool 108. The invention 100 is a multifunctional device adapted for use with personal data devices. Specifically, the invention 100 is a housing 101 that contains a plurality of earphones 102, a control system to remotely control the personal data device, and a power distribution system designed to charge personal data devices.

The housing 101 is a casing that is used to contain the invention 100. The housing 101 further comprises a rigid case 111, a key ring 112, a belt clip 113, a first flap 114, and a second flap 115. The belt clip 113 further comprises a pivot 116 and a spring clip 117. The rigid case 111 is a container made of a rigid material. The rigid case 111 contains, or has mounted on it, the remaining components of the invention 100. The key ring 112 is a loop that is formed in the rigid case 111. The key ring 112 allows users to attach fasteners, such as a carabiner, to the invention 100. The belt clip 113 further comprises a pivot 116 and a spring clip 117. The spring clip 117 is attached to the rigid case 111 using the pivot 116. The pivot 116 allows the spring clip 117 to rotate freely using the pivot 116 as a pivot point. The spring clip 117 allows the housing 101 to be secured a strap or other belt like object. The housing 101 further comprises a first earphone port 141, a second earphone port 142, a USB A port 122, a plug channel 143, and a jack port 144.

The first earphone port 141, the second earphone port 142, the USB A port 122, the plug channel 143, and the jack port 144 are all apertures that provide access to the functionality of the invention 100 that is contained within the housing 101. The first earphone port 141, the second earphone port 142, the USB A port 122, the plug channel 143, and the jack port 144 are all discussed elsewhere in this disclosure. The first flap 114 is a flexible cover that is used to close the first earphone port 141 when the first earphone 131 is stored within the housing 101. The second flap 115 is a flexible cover that is used to close the second earphone port 142 when the second earphone 132 is stored within the housing 101.

The charger 105 further comprises prongs 121 and a USB A port 122. The prongs 121 are two metal prongs that are NEMA 5-15 compliant electrical connectors that can be used to connect the invention 100 to the national electric grid. The prongs 121 are stored in the plug channel 143. The plug channel 143 is a cavity formed in the surface of the rigid case 111 that is sized to receive the prongs 121 when the prongs 121 are not in use. The prongs 121 are hinged such that the prongs 121 can be rotated away from the plug channel 143 such that the prongs 121 project perpendicularly away from the surface of the rigid case 111. In this position, the prongs 121 can be plugged into an electrical socket to draw power from the national electric grid. Electric power received from the national electric grid is then rectified, conditioned, and the voltage is adjusted such that the electric power can be used to power personal data devices. Methods to rectify, condition, and adjust the voltages of electric power are well known and documented in the electrical arts.

The USB A port 122 is a second power connection that allows the invention 100 draw electric power from electronic devices through the use of a USB A compatible cable and plug attached to an external electronic device. The USB A port 122 is mounted in the plug port 145 of the rigid case 111. The power provided to the invention 100 through the USB A compatible cable and plug is already suitable for use by personal data devices and needs no further conditioning. Methods to switch electric power distribution between two power sources are well known and documented in the electrical arts.

The housing 101 contains the first retractable spool 107 and the second retractable spool 108. The first retractable spool 107 is a commercially available spring loaded spool that is used to store the earphones 102. The earphone 102 further comprises a first earphone 131, a second earphone 132, an earphone cable 133, and an earphone jack 134. The earphone cable 133 is loaded onto the first retractable spool 107 such that both the first earphone 131, the second earphone 132, and the earphone jack 134 can be extended out of the housing 101 through the first earphone port 141, the second earphone port 142, and the jack port 144 respectively. The first retractable spool 107 is designed such that the spring of the first retractable spool 107 is placed under tension when the first earphone 131, the second earphone 132, and the earphone jack 134 are extended out of the housing 101.

When the first earphone 131, the second earphone 132, and the earphone jack 134 are to be retracted back into the housing 101, the spring will provide the motive force required to rewind the earphone cable 133 onto first retractable spool 107. Methods to feed a cable on a retractable spool such that both ends of the cable can be extended and retracted are well known and documented in the art. The second retractable spool 108 is a commercially available spring loaded spool that is used to store the USB cable plug 123. The USB cable plug 123 is a cable and plug that provides electrical power from the charger 105 to a personal data device. The USB cable plug 123 is stored on the second retractable spool 108 such that the USB cable plug 123 can be extended through the jack port 144. The second retractable spool 108 is designed such that the spring of the second retractable spool 108 is placed under tension when the USB cable plug 123 is extended out of the housing 101. When the USB cable plug 123 is to be retracted back into the housing 101, the spring will provide the motive force required to rewind the earphone cable 133 onto the second retractable spool 108.

The earphones 102 are associated with the operation of the volume control 103 and the audio source control 104. The volume control 103 further comprises a volume up button 135 and a volume down button 136. The volume up button 135 sends a signal to the personal data device over the earphone cable 133 to increase the audio volume of the audio file being processed. The volume down button 136 sends a signal to the personal data device over the earphone cable 133 to decrease the audio volume of the audio file being processed. The audio source control 104 further comprises a forward button 137 and a back button 138. The forward button 137 sends a signal to the personal data device over the earphone cable 133 to move to the next audio file. The back button 138 sends a signal to the personal data device over the earphone cable 133 to move to the prior audio source file. Methods to control the operation of personal data devices in this manner are well known and documented in the electrical arts.

To use the invention 100 to listen to an audio file, the earphone jack 134 is plugged into the personal data device and the first earphone 131 and the second earphone 132 are inserted into the ear canals of the wearer. The audio volume generated by the speaker in the first earphone 131 and the speaker in the second earphone 132 is controlled through the use of the volume control 103. The selection of the audio source processed by the personal data device is controlled through the audio source control 104. To use the invention 100 as a charger 105, the invention 100 is connected to either the national electric grid or a USB compatible power source at the user's discretion. The USB cable plug 123 is then plugged into the personal data device that is to be powered.

The rigid case 111 and the key ring 112 are formed as a single unit from molded plastic. Suitable plastics include, but are not limited to, polyethylene or polycarbonate. The remaining components are commercially available.

The following definitions were used in this disclosure:

Audio File: As used in this disclosure, an audio file is a digital representation of a sound that is used to store a recording of the sound. Separate hardware is used to convert the digital representation of the sound into an audible sound.

Audio Source: As used in this disclosure, an audio source is a device that generates electrical signals that can be converted in to audible sounds by a speaker.

Carabiner: As used in this disclosure, a carabiner is coupling link that is usually formed as an oblong metal ring with one spring hinged side that is used to open and close the ring. Synonyms for carabiner include D-link.

Earphone: As used in this disclosure, an earphone refers to a device that converts electrical signals into audible sounds that are worn or listened to in contact with the ear.

Fastener: As used in this disclosure, a fastener is a device that is used to join or affix two objects. Jack: As used in this disclosure, a jack is a port that is designed to receive a plug in order to make an electrical connection.

Personal Data Device: As used in this disclosure, a personal data device is a handheld device that is used for managing personal information and communication.

Examples of personal data device include, but are not limited to, cellular phones, tablets and smart phones.

Plug: As used in this disclosure, a plug is a device at the end of an electrical cord that connects the cord to an electrical device or a source of electricity.

Socket: As used in this disclosure, a socket is an electrical device that is designed to receive and transfer electricity to a plug and to transfer electricity.

Speaker: As used in this disclosure, the term a speaker is an electrical device that converts an electrical signal into an audible sound.

USB: As used in this disclosure, USB is an acronym for Universal Serial Bus which is an industry standard that defines the cables, the connectors, the communication protocols and the distribution of power required for interconnections between electronic devices. The USB standard defines several connectors including, but not limited to, USB-A, USB-B, mini-USB, and micro USB connectors.

With respect to the above description, it is to be realized that the optimum dimensional relationship for the various components of the invention described above and in FIGS. 1 through 6, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A multifunctional device comprising:

a housing, a plurality of earphones, a volume control, an audio source control, a charger, a USB cable plug, a first retractable spool, and a second retractable spool;

wherein the multifunctional device is a adapted for use with personal data devices;

wherein the multifunctional device comprises the plurality of earphones and a control system to remotely control the personal data device;

wherein the multifunctional device comprises a power distribution system designed to charge personal data devices;

wherein the housing is a rigid casing that is used to contain the multifunctional device;

wherein the housing further comprises a rigid case, a key ring, a belt, a first flap, and a second flap;

wherein the belt clip further comprises a pivot and a spring clip;

wherein the key ring is a loop that is formed in the rigid case;

wherein the spring clip is attached to the rigid case using the pivot;

wherein the spring clip rotates freely;

wherein the housing further comprises a first earphone port, a second earphone port, a USB A port, a plug channel, and a jack port;

wherein the first flap is a flexible cover that is used to close the first earphone port;

wherein the second flap is a flexible cover that is used to close the second earphone port;

wherein the charger further comprises a plurality of prongs and a USB A port;

wherein the plurality of prongs are stored in the plug channel;

wherein the plug channel is a cavity formed in the surface of the rigid case that is sized to receive the prongs;

wherein the prongs are hinged.

2. The multifunctional device according to claim 1 wherein the electric power received from the national electric grid is rectified, conditioned, and the voltage is adjusted such that the electric power can be used to power personal data devices.

3. The multifunctional device according to claim 2 wherein the USB A port is mounted in the plug port of the rigid case.

4. The multifunctional device according to claim 3 wherein the housing contains the first retractable spool and the second retractable spool.

5. The multifunctional device according to claim 4 wherein the first retractable spool is used to store the earphones;

wherein the earphones further comprise a first earphone, a second earphone, an earphone cable, and an earphone jack;

wherein the earphone cable is loaded onto the first retractable spool such that both the first earphone, the second earphone, and the earphone jack can be extended out of the housing through the first earphone port, the second earphone port, and the jack port respectively.

6. The multifunctional device according to claim 5 wherein the second retractable spool is used to store the USB cable plug;

wherein the USB cable plug is a cable and plug that provides electrical power from the charger to the personal data device;

wherein the USB cable plug is stored on the second retractable spool such that the USB cable plug can be extended through the jack port.

7. The multifunctional device according to claim 6 wherein the volume control further comprises a volume up button and a volume down button.

8. The multifunctional device according to claim 7 wherein the audio source control further comprises a forward button and a back button.

* * * * *